US005207612A

United States Patent [19]

Wollaston

[11] Patent Number: 5,207,612

[45] Date of Patent: May 4, 1993

[54] COIN BANDER

[76] Inventor: Graham Wollaston, 2415 Tangly #20, Houston, Tex. 77005

[21] Appl. No.: 755,089

[22] Filed: Sep. 5, 1991

[51] Int. Cl.[5] ..... G07D 9/06; B65D 65/04

[52] U.S. Cl. ..... 453/61; 206/0.8; 206/0.82; 229/87.2

[58] Field of Search ..... 453/58, 59, 61, 62, 453/63; 206/0.8, 0.81, 0.82, 445; 229/87.2

[56] References Cited

U.S. PATENT DOCUMENTS

| | | | |
|---|---|---|---|
| 202,188 | 4/1878 | Ostergard | 453/61 |
| 209,637 | 11/1878 | Whittic | 206/0.82 |
| 211,321 | 1/1879 | Dennis | 206/0.82 |
| 212,867 | 3/1879 | Olmsted | 206/0.82 |
| 655,565 | 8/1900 | Mercer | 206/0.81 X |
| 803,395 | 10/1905 | Butler | 206/0.82 |
| 831,115 | 9/1906 | Spurgin | 229/87.2 |
| 888,539 | 5/1908 | Simpson | 453/58 X |
| 1,130,978 | 3/1915 | Jackson | 453/61 X |
| 1,333,087 | 3/1920 | McGurk | 229/87.2 |
| 1,379,751 | 5/1921 | Downey | 229/87.2 |
| 1,435,165 | 11/1922 | Kochka | 229/87.2 |
| 1,717,669 | 6/1929 | DEX | 229/87.2 |
| 1,757,008 | 5/1930 | Doble | 206/0.82 |
| 2,150,473 | 3/1939 | Wagner | 453/62 X |
| 2,260,150 | 10/1941 | Millard | 229/87.2 |
| 2,275,424 | 3/1942 | Freedman | 206/445 X |
| 2,997,201 | 8/1961 | Prato | 206/0.8 X |
| 3,092,304 | 6/1963 | Kerrell | 229/87.2 |
| 3,139,976 | 7/1964 | Swain | 206/0.82 |
| 3,347,450 | 10/1967 | Godwin | 229/87.2 |
| 3,756,299 | 9/1973 | Simmons et al. | 206/0.82 X |
| 4,184,590 | 1/1980 | Tenbrink, Sr. | 206/0.82 |
| 4,905,823 | 3/1990 | Kara | 206/0.82 |

FOREIGN PATENT DOCUMENTS

| | | | |
|---|---|---|---|
| 40209 | 7/1909 | Fed. Rep. of Germany | 206/0.82 |
| 1033815 | 7/1953 | France | 206/0.82 |
| 1139819 | 7/1957 | France | 453/61 |
| 1521201 | 4/1968 | France | 206/0.80 |

*Primary Examiner*—Michael S. Huppert
*Assistant Examiner*—Scott L. Lowe

[57] ABSTRACT

A flexible coin bander having two semi-rigid ends that are suitably fixed to two flexible, inelastic sides of a predetermined length; the two semi-rigid ends and flexible sides essentially form a rectangle around a row of coins of a specific denomination and number. The coins are held in a semi-rigid configuration forming a shaft wherein the rigidity is achieved only by the combination of an exact number of coins being tightly pressed together between the semi-rigid ends and the flexible, inelastic sides. The coins are easily placed into or removed from the coin bander. The configuration makes this coin bander easily reusable, and, thus, the invention is an ideal coin holder for bank usage, cash drawers in business, and general coin storage in the home.

11 Claims, 5 Drawing Sheets

COIN BANDER

BACKGROUND OF THE INVENTION

This invention relates to coin holders of the type shown, for example, in U.S. Pat. Nos.:

202,188 to V. Ostergard, Apr. 9, 1878
202,637 to V. W. Whittic, Nov. 5, 1878
211,321 to O. A. Dennis, Jan. 14, 1879
212,867 to L. H. Olmsted, Mar. 4, 1879
655,565 to J. B. Mercer, Aug. 7, 1900
831,115 to R. Spurgin, Sept. 18, 1906
1,333,087 to E. F. McGurk, Mar. 1920
1,379,751 to C. L. Downey, May 31, 1921
1,435,165 to N. F. Kochra, Nov. 14, 1922
1,717,669 to C. L. Downey, Jun. 18, 1929
1,042,022 to F. C. Schmoker, May 26, 1936
2,260,150 to J.S . Millard, Oct. 21, 1941
2,275,424 to B. H. Freedman, Mar. 10, 1942
3,092,304 to R. C. Kerrell, June 4, 1963
3,127,009 to M. J. Feis, et al, Mar. 31, 1964
3,139,976 to S. F. Swain, Jul. 7, 1964
3,347,450 to O. L. Godwin, Oct. 17, 1967
4,184,590 to Arthur Tenbrink, Jan. 22, 1980
4,905,823 to Nasir Kara, Mar. 6, 1990

The coin holder of Whittic must have a knot or a bow tied in order to hold the coins, which is difficult and time consuming on such a small item. If a latch is used as in Whittic, it can come undone in one's pocket or coin drawer, thus allowing the coins to fall out. Another coin holder was invented by Dennis (referred to as a coin package), and was made out of metal bands in which one band must be rotated to be opened or closed. The metal bands take up space and can cut a person while grasping the coin holder. It cannot be folded up for storage. The Olmsted and the Mercer inventions also use metal bands that cannot be folded The other above-mentioned inventions are either paper or plastic wrappers that are broken open and cannot be reused. Some of the coin holders are metal cylinders or bands that cannot be compressed or refolded for storage and reuse.

Most of these designs are not reusable, or they must be made out of metal that is difficult to store, or they take up extra space in the cash drawer, or they are difficult to open to extract the coins, or they can accidentally or unintentionally come apart causing uncontrolled spillage.

SUMMARY OF THE INVENTION

The object of the present invention is to provide a method and device to hold and band coins in precise numbers without the need to pre-count the coins.

Another object of this invention is to provide a coin holding device that can be collapsed to the approximate size of the coin.

Another object of the invention is the ability to distinguish a coin in the band that is not of the same denomination as the others. By way of example, a dime inserted in a banded roll of pennies would be distinguishable at first glance as a coin of the wrong denomination, and the banded coins would not become a rigid shaft.

Another object of the invention is the ease in which the coins can be extracted from the band in a controlled manner thus preventing spillage or the need to cut, break, strike, hit, or use some other method to extract the coins Still another object of the present invention is to provide a device that can easily release the coins into a cash box or drawer and yet be recycled or reused for other coins.

Yet another object of the present invention is to provide a coin holding device that can safely be carried in one's The latching coin bander of claim 4, wherein said pocket or purse.

The foregoing and other objects and advantages are attained by a coin holding device with semi-rigid ends and flexible, yet inelastic sides of a predetermined exact length In accordance with another feature of the present invention, the sides are made of mylar, paper, or some other suitable plastic or material that is flexible, yet inelastic and will not stretch from a predetermined length.

The features of the present invention can be best described and understood with further objects and advantages by reference to the following descriptions taken in conjunction with the following drawings, wherein like numerals indicate like parts

DETAILED DESCRIPTION OF INVENTION

Figure 1:
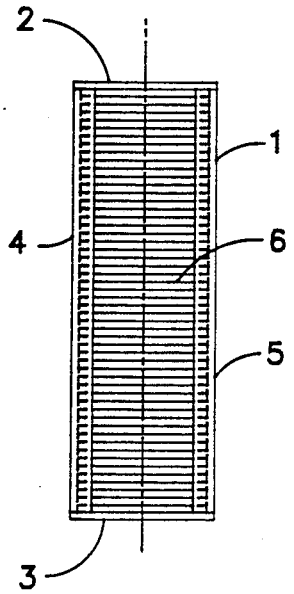
FIG. 1: An elevation of the preferred embodiment of the present invention shown holding coins.

Referring to FIG. 1, there is shown an elevation view of the coin bander 1 banded around a predetermined stack of coins 6 of any denomination or national currency, forming a rigid shaft of coins. The coin bander 1 has a semi-rigid first end 2 and a semi-rigid second end 3, both of which are the same diameter of the coins that the coin bander is designed to hold and further has a first flexible band 4 and a second flexible band 5. The first and second flexible bands 1 and 5 are made of a material such as vinyl, mylar, paper, cloth, or some other suitable material that is flexible yet inelastic, and are suitably fixed to the outermost diameter of the first semi-rigid end 2 and the second semi-rigid end 3. The first semi-rigid end 2 and the second semi-rigid end 3 are made of a semi-rigid vinyl, plastic, metal, wood, or another suitable material The coins 6 are shown to be perpendicular to said first flexible band 4 and said second flexible band 5 and further the coins 6 are parallel to said semi-rigid first end 2 and said semi-rigid second end 3.

The distance between the first semi-rigid end z and the second semi-rigid end 3 is the exact number of coins 6 that one may wish to pack into the coin bander 1; this is a matter of design choice based on the type and number of coins to be held such as forty quarters or fifty pennies example only.

Figure 2:
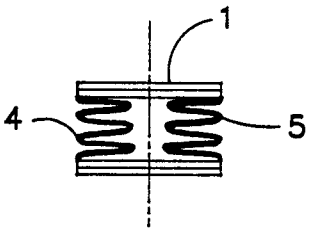
FIG. 2: An elevation of the preferred embodiment of the present invention shown in a folded condition.

Referring to FIG. 2, there is shown the coin bander compressed into a smaller object. The coin bander 1 may be compressed because the first flexible band 4 and the second flexible band 5 are made out of a flexible material Referring to FIG. 3, there is shown an elevation of the coin bander 4 without any coins in it The first flexible band 4 and the second flexible band 5 are shown covering about a quarter of the circumference of the semi-rigid first end 2 and the semi-rigid second end 3.

The first flexible band 4 is shown with specific predetermined length with a first end and a second end. The first flexible band 4 is shown having the first end suitably fixed to the outermost diameter of the first semi-rigid end 2 and the second end of the first flexible band 4 is shown suitably fixed to the outermost diameter of the second semi-rigid end 3. The first flexible band 4 has a specific width greater than one quarter of the circumference of a specific coin.

The second flexible band 5 is shown having a first end and a second end and the first end of the second flexible band 5 is shown suitably fixed to the outermost diameter of the first semi-rigid end 2 and the second end of the second flexible band 5 is shown suitably fixed to the outermost diameter of the second semi-rigid end 3. The second flexible band 5 has a specific width greater than one quarter of the circumference of a specific coin.

Figure 4:
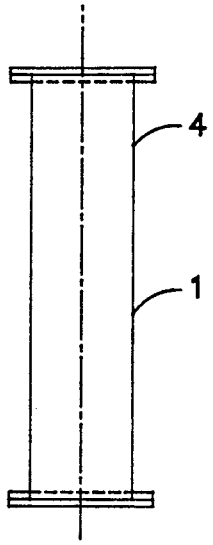
FIG. 4: An elevation of the preferred embodiment of the present invention shown at 90° angle to FIG. 3.

Referring to FIG. 4, there is shown another elevation view of the coin bander 1 without any coins in it. The band shown is of a specific width and could be the first flexible band 4 or the second flexible band.

Figure 5:
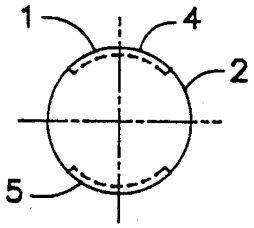
FIG. 5 An end view as taken from FIG. 3.

Referring to FIG. 5, there is shown an end view of the coin bander 1. Although the first semi-rigid end 2 is shown, it could also be the second semi-rigid end because both rigid ends are similar. The first end of the first flexible band 4 and the first end of the second flexible band 5 are shown directly opposite of each other and each flexible band is shaped to conform to the outermost diameter of the first semi-rigid end 2.

The first flexible band 4 is shown on the first side and the second flexible band 5 is shown on the other side as hidden lines.

Figure 3:
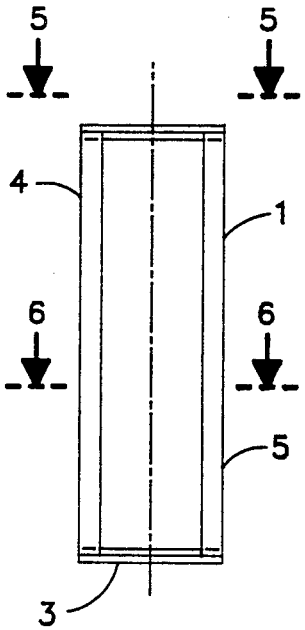
FIG. 3: An elevation of the preferred embodiment of the present invention shown without coins.
Figure 6:
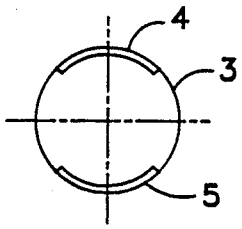
FIG. 6: A section view as taken through FIG. 3.

Referring to FIG. 6, there is shown a section view of second semi-rigid end 3 as taken though FIG. 3.

The second end of the first flexible band 4 and the second end of the second flexible band 5 are shown rounded to the outermost diameter of the second semi-rigid end 3 and suitably fixed to the second semi-rigid end 3 or the first semi-rigid end 2 by an adhesive or other suitable means by design choice. The first flexible band 4 is further shown directly opposite of the second flexible band 5. The first flexible band 4 and the second flexible band 5 have a specific width greater than one quarter of the circumference of a specific coin.

Figure 7:
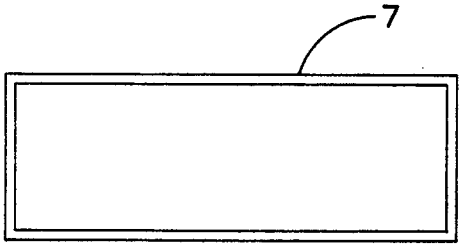
FIG. 7: A plan view of a box to hold the present invention while it is being filled with coins.

Referring to FIG. 7, there is shown a plan view of a coin bander support frame 7. The coin bander 1 is placed into the support frame 7 and the coins are then placed into the coin bander. The support frame 7 prevents the coins from falling out of the coin bander 1 while it is being filled with coins.

Figure 8:
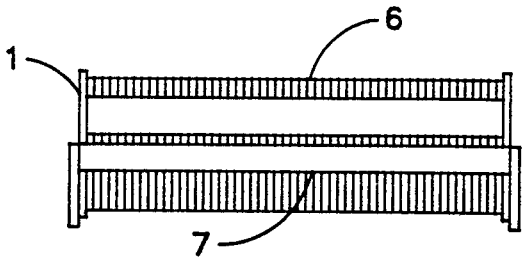
FIG. 8: A side elevation of the box of FIG. 7, shown supporting the coin bander with coins.

Referring to FIG. 8, there is shown an elevation view of the coin bander support frame 7 with coins 6 banded together by the coin bander 1.

Figure 9:
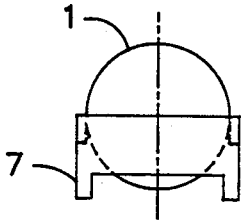
FIG. 9: An end elevation of FIG. 7.

Referring to FIG. 9, there is shown an end view of the coin bander support frame 7 supporting the coin bander 1 The first semi-rigid end 2 is shown in the support frame 7

Figure 10:
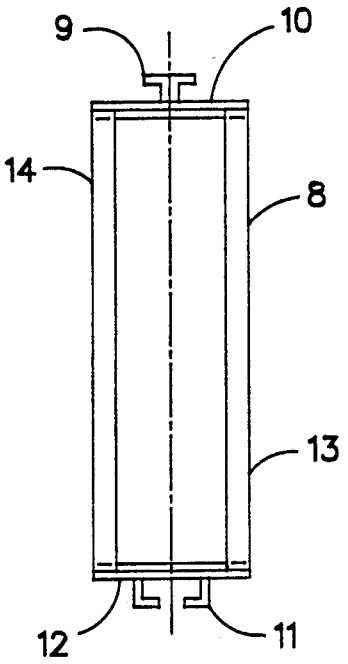
FIG. 10: An elevation of the second preferred embodiment showing upper and lower U and T latches that will allow coin bander to be fastened to another coin bander.

Referring to FIG. 10, there is shown an elevation view of a second preferred embodiment of a latching coin bander 8 with a T slide latch 9 fixed to the first rigid end 10 and a U slide latch 11 fixed to the second rigid end 12.

A first flexible band 13 is shown on the first side of the latching coin bander 8 and a second flexible band 14 is shown on the second side of the latching coin bander 8.

The T slide latch 9 will be of a suitable size to fit into the U slide latch 11 of another similar latching coin bander 8. This will allow one latching coin bander 8 to be suitably attached to another latching coin bander 8.

Figure 11:
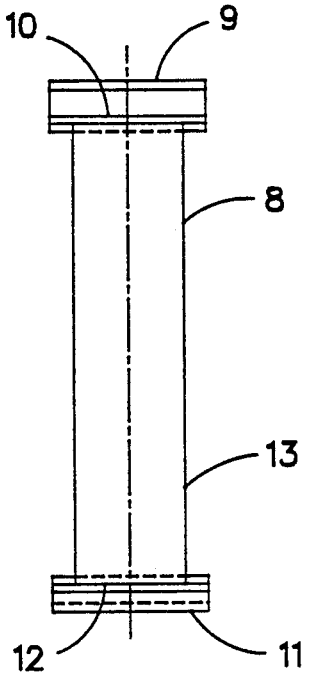
FIG. 11: A side elevation at 90° angle to FIG. 10.

Referring to FIG. 11, there is shown a side elevation of the latching coin bander 8.

The T slide latch 9 is shown suitably fixed to the first rigid end 10 and the U slide latch 11 is shown to the second rigid end 12. The first flexible band 13 is shown suitably fixed to the first rigid end 10 and the second rigid end 12. The second flexible band 14 is on the other side and cannot be seen in this view.

Figure 12:
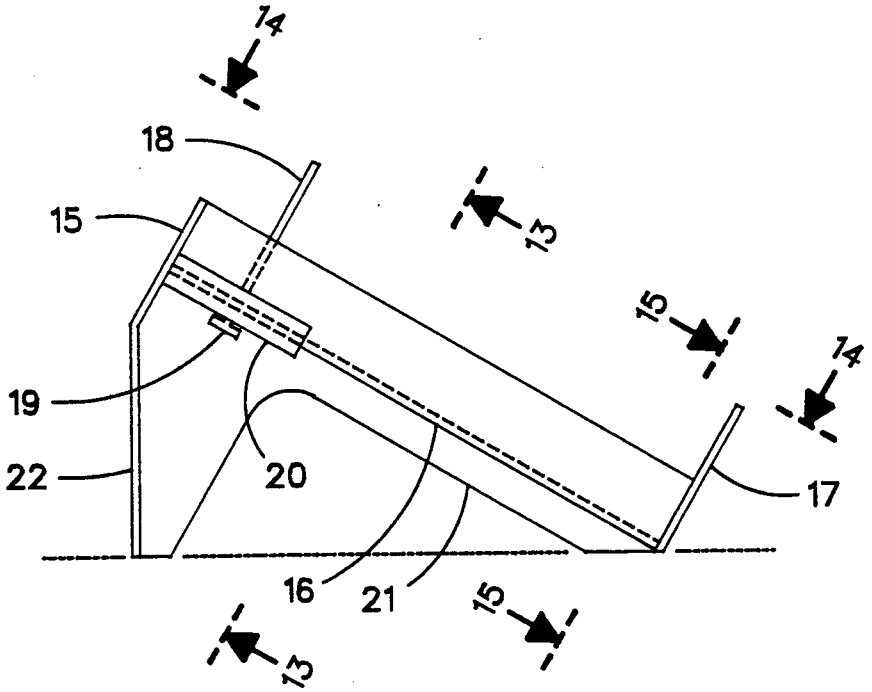
FIG. 12: An elevation of an adjustable cradle to hold the coin bander while it is being filled

Referring to FIG. 12, there is shown an elevation view of the adjustable support cradle 15.

The latching coin bander 8 would be manufactured to hold a specific number of coins 6 of a specific denomination of a specific national currency and therefore one latching coin bander 8 that could hold (as an example only) fifty nickels would be somewhat longer than a latching coin bander s that would hold fifty dimes. To hold the latching coin bander s of different denominations the device to hold the latching coin bander s would have to be adjustable. The adjustable support cradle 15 will hold latching coin banders 8 of different lengths.

The adjustable support cradle 15 has a sloping cradle 16 that extends from the lower end of the adjustable support cradle 15 to the upper end of the adjustable support cradle 15. At the lower end of the adjustable support cradle 15 is the slotted end 17. At the upper end of the adjustable support cradle 15 is the adjusting bar 18 and the guide bar 19. The adjusting bar 18 is suitably fixed to the guide bar 19 to allow the adjusting bar 18 to be moved parallel to or along the centerline of the sloping cradle 16. The guide bar 19 is held in place by the guide slot bars 20 on each side of the guide bar 19. The adjustable support cradle 15 is with a support member 21 in the center of the sloping cradle 16 and two leg means 22 to elevate one end of the sloping cradle 16.

Figure 13:
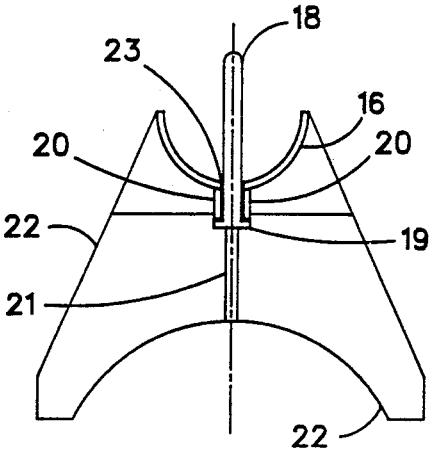
FIG. 13: A section elevation as taken through FIG. 12.

Referring to FIG. 13, there is shown a section elevation taken through FIG. 12.

The leg means 12 are shown supporting the sloping cradle 16 and the support member 21 is shown suitably fixed to the leg means 22. The adjusting bar 18 is shown fixed to the guide bar 19 and is held in place in the cradle slot 23 by the guide slot bars 20.

Figure 14:
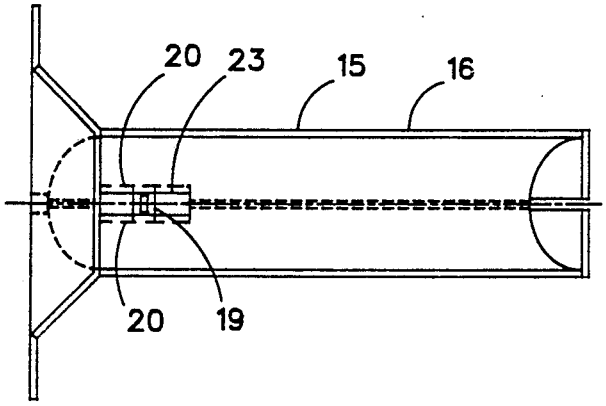
FIG. 14: A plan view of an adjustable cradle shown in FIG. 12 to hold a coin bander.

Referring to FIG. 14, there is shown a plan view of the adjustable support cradle 15. The sloping cradle 16 is with the slotted end at the first end of the sloping cradle 16 and the guide bar 19 at the second end of the sloping cradle 16. The guide bar 19 is shown inside of the cradle slot 23 and the guide slot bars 20 are shown as hidden lines on each side of the cradle slot 23.

Figure 15:
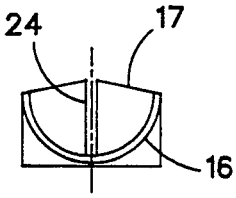
FIG. 15: A section elevation as taken through FIG. 12

Referring to FIG. 15, there is shown the slotted end 17 of the sloping cradle 16. The slotted end 17 has a slot 24 showing, the purpose of which will be explained in FIG. 16.

Figure 16:
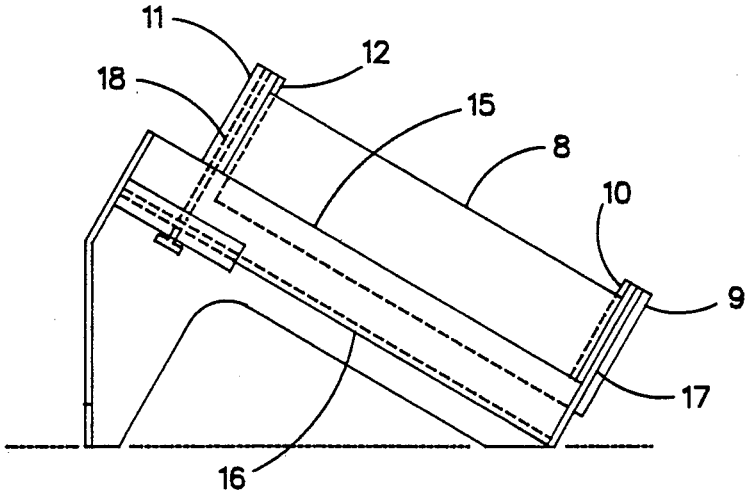
FIG. 16: An elevation view of the adjustable cradle supporting the coin bander without coins

Referring to FIG. 16, there is shown the adjustable support cradle 15 holding a latching coin bander s prior to placing coins 6 into the latching coin bander 8.

The T slide latch 9 at the first rigid end 10 of the latching coin bander 8 is shown inserted into the slot of the slotted end 17 of the sloping cradle 16

The U slide latch 11 on the second rigid end 12 of the latching coin bander 8 is shown around the adjusting bar 18 that can be moved in the cradle slot 23 in order to accommodate any length of latching coin bander 8.

The adjustable support cradle 15 has a sloping cradle 16 to allow coins 6 to be set on and against the slotted end without the coins 6 falling over.

Figure 17:
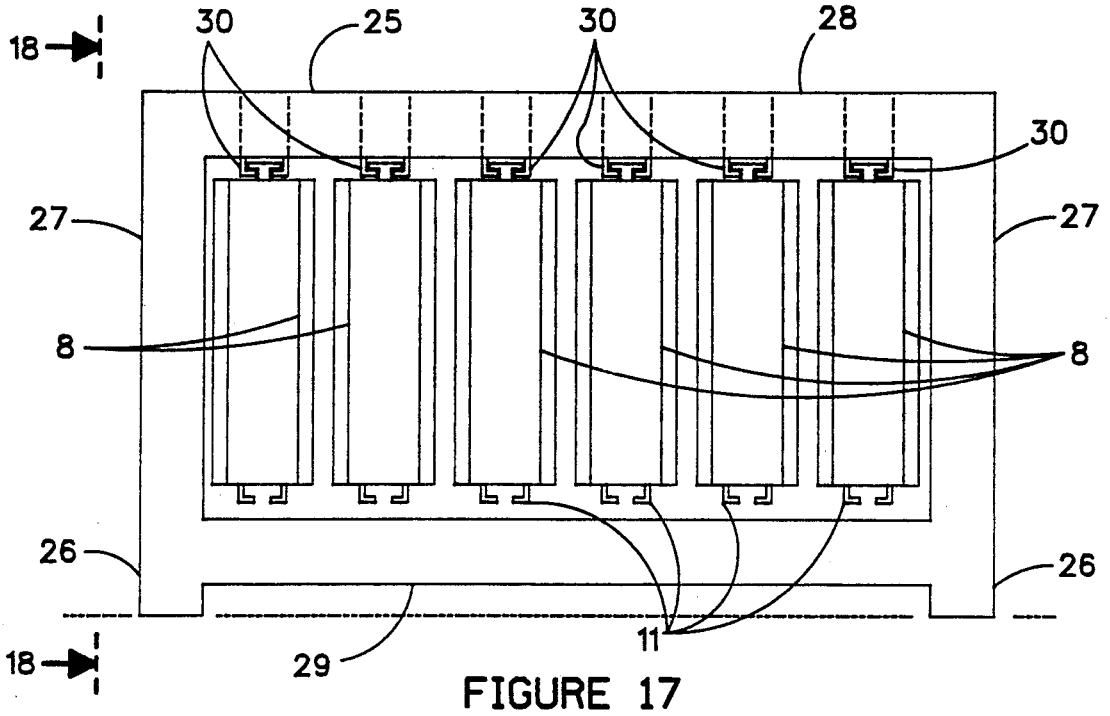
FIG. 17: A frontal elevation of coin rack holding coins in coin banders.

Referring to FIG. 17, there is shown a latching coin bander rack 25.

The latching coin bander rack 25 has four vertical supports 27, four upper horizontal supports 28 forming a rectangle and four lower horizontal supports 29 which also form a rectangle. The latching coin bander rack 25 further is shown with six U SLOT racks 30 that have the same section of the U slide latch 11 of the latching coin bander 8.

The T slide latch 9 of the latching coin bander 8 is inserted into the U slot rack 30 and supported within the frame of the latching coin bander rack 25. This will allow coins 6 to be stored in a neat and precise manner. The latching coin bander rack 25 is shown supported on legs 26.

Figure 18:
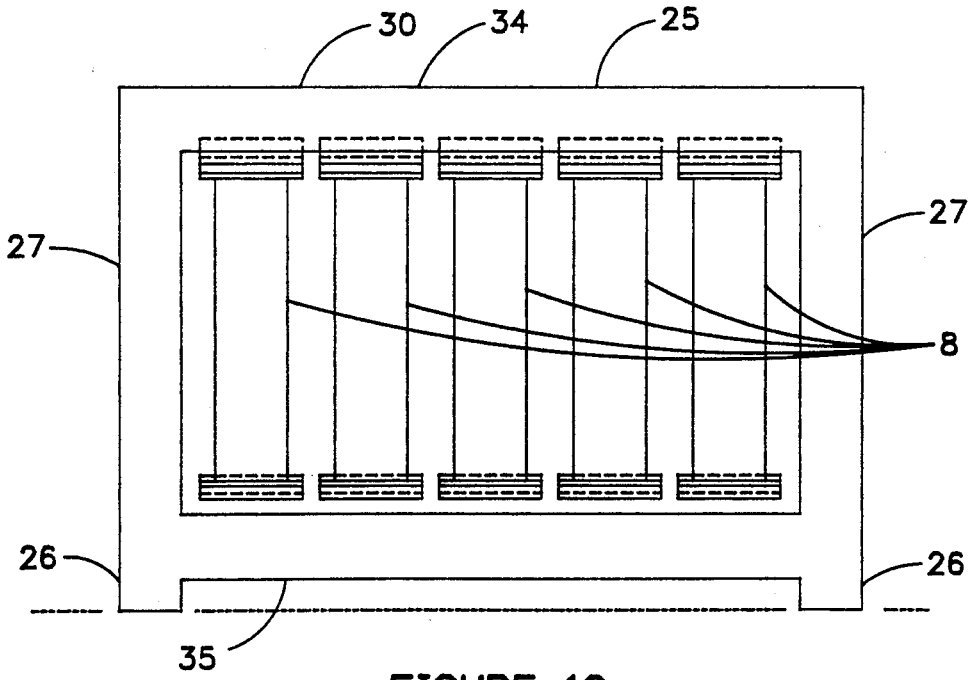
FIG. 18: A side elevation of the coin rack as taken from FIG. 17.

Referring to FIG. 18, there is shown an elevation view as taken from FIG. 17 of the latching coin bander rack 25.

The outer U slot rack 30 is shown supporting more than one latching coin bander 8 which may or may not be filled with coins The vertical supports 27 are shown on each side suitably fixed to the side upper horizontal support 34 and the side lower horizontal support 35. The latching coin bander rack 25 is also shown supported on legs 26.

Figure 19:
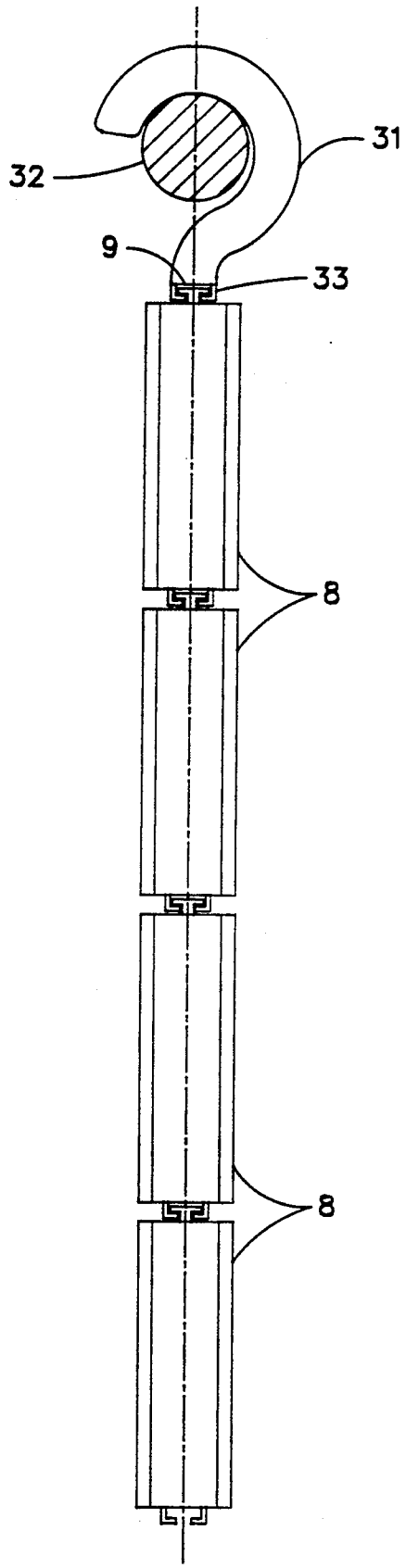
FIG. 19: An elevation view of a closet coin hanger.

Referring to FIG. 19, there is shown still another means of storing coins by assembling two or more latching coin banders 8 in a vertical column. In this case, the latching coin banders 8 may or may not all have coins 6 in them, but they may be hung from the bottom of a hanger means 31 that is suspended from a bar 32 that may be in a closet or storage area The hanger means 31 is shown with a latching coin bander U SLIDE LATCH 33; the T slide latch 9 of the latching coin bander 8 slides into the U slide latch 33. Another latching coin bander 8 is hung from the first latching coin hanger s until any number can be hung from each other.

Although the system described in detail supra has been found to be most satisfactory and preferred, many variations are possible. For example, there could be three or more flexible bands or there could be more than two rigid ends.

Although the invention has been described with reference to the preferred embodiment, it will be understood by those skilled in the art that additions, modifications, substitutions, deletions, and other changes not specifically described, may be made in the embodiments herein, it should be understood that the details herein are to be interpreted as illustrative and are not in a limiting sense.

What is claimed is:

1. A coin bander for holding and storing coins of a predetermined specific number and a specific denomination of coins of a specific national currency wherein one said coin bander may be slidably attached to another coin bander comprising a round rigid first end with a specific diameter;

a round rigid second end with the same specific diameter as said round rigid first end;

a T slide latch wherein said T slide latch is essentially in the shape of a T and wherein said T is suitably fixed to said round rigid second end;

a U slide larch wherein said U slide latch is essentially in the shape of a U and wherein said U slide latch is suitably fixed to said second rigid end;

a first flexible band having a specific length with a first end and a second end and further having a specific width and wherein said specific width is shaped to the same said diameter as said round rigid first end and said round rigid second end;

a second flexible band having the same specific length as said first flexible band and wherein said second flexible band has a first end and a second end and the same specific width as the said first flexible band and wherein specific width is shaped to the same said specific diameter as said round rigid first end and said round rigid second end;

wherein said first end of said first flexible band is suitably fixed to said round rigid first end at the outermost diameter of said round rigid first end and said second end of said first flexible band is further fixed to said round rigid second end at the outermost diameter of said round rigid second end, and wherein said first end of said second flexible band is fixed to said round rigid first end directly opposite of said first flexible band at the outermost diameter of said round rigid first end, and said second end of said second flexible band is fixed to said round rigid second end, wherein said specific coins of a specific denomination and currency are placed between and perpendicular to said first flexible band and said second flexible band and wherein said coins are further placed between said round rigid first end and said round rigid second end and wherein when the predetermined specific number of coins are placed between the first rigid end and the second rigid end and the first flexible band and the second flexible band, the said coins are further pressed together forming a rigid shaft of said coins banded together by said coin bander and where one said rigid shaft of said coins is further suitably attached to another rigid shaft of said coins by sliding said T slide latch into said U slide latch thus fixing one said rigid shaft of coins banded together in a said coin bander to another said rigid shaft of coins banded together in a coin bander.

2. The coin bander of claim 1 wherein said coin bander can be suitably fixed to a second coin bander and further a third coin bander can be suitably fixed to said second coin bander 3. The coin bander of claim 1 wherein said coin bander filled with coins can be hung from a hanger means that is hung from a bar comprising:

a bar, said bar is horizontal;

at least one hanger means, said hanger means is hung from said bar;

a U slide latch wherein said U slide latch is fixed to said hanger means;

a coin bander with a upper end and a lower end wherein said coin bander has a U slide latch on the lower end and a T slide latch fixed to the upper end of said coin bander wherein said T slide latch fixed to the upper end of said coin bander is slid into said U slide latch of said hanger means thus hanging at least one coin bander from said hanger means.

4. A latching coin bander rack for supporting at least one latching coin bander comprising:

at least four vertical supports;

at least four upper horizontal supports fixed to said four vertical supports;

at least four lower horizontal supports fixed to said four vertical supports;

at least one U slot rack fixed to said upper horizontal supports;

said U slot rack further having at least one U slot;

at least one coin bander wherein said coin bander has a first rigid end and a second rigid end and wherein said coin bander has two flexible bands extending from said first rigid end to said second rigid end in wherein each flexible band is further fixed to said first rigid end and said second rigid end;

a sliding U latch fixed to said first rigid end;

a sliding T latch fixed to said second rigid end wherein said sliding T latch is inserted into said U slot of said U slot rack and wherein said U slot rack is supported by said upper horizontal supports and said upper horizontal supports further essentially form a rectangle and further suspends said latching coin bander above said lower horizontal supports that also essentially form a rectangle and wherein said coin bander may be filled with coins and placed in said coin bander rack and be held in place within said coin bander rack with other coin banders filled with coins.

5. The latching coil bander of claim 4 wherein said first flexible band and said second flexible band are made out of plastic.

6. The latching coin bander of claim 4 wherein said first flexible band and said second flexible band are made out of paper.

7. The latching coin bander of claim 4, wherein said first flexible band and said second flexible band are made out of cloth.

8. The latching coin bander of claim 4, wherein said round semi-rigid first end and said round semi-rigid second end are made out of plastic.

9. The latching coin bander of claim 4, wherein said round semi-rigid first end and said round semi-rigid second end are made out of wood.

10. The latching coin bander of claim 4, wherein said round semi-rigid first end and said round semi-rigid second end are made out of metal.

11. An adjustable support cradle to support and hold a latching coin bander of a specific length while and coin bander is being filled with coins comprising:

a sloping cradle wherein said sloping cradle has an end;

upper end and a lower and wherein said sloping cradle is round in section;

a slotted end wherein said slotted end is fixed perpendicular to said lower end of said sloping cradle and wherein said slotted end has a top end and a bottom end and wherein a slot is formed in said slotted end, said slot extends from said top end to said bottom end;

a cradle slot wherein said cradle slot is formed into said sloping cradle at said upper end of said sloping cradle and wherein said cradle slot partially extends downward in said sloping cradle;

an adjusting bar wherein said adjusting bar extends from the cradle slot to above the cradle;

a guide bar fixed to said adjusting bar below the sloping cradle wherein said bar is wider than said cradle slot thereby preventing said adjusting bar from being pulled out of said cradle slot;

a leg means fixed to said upper end of said sloping cradle wherein said leg means extends below said upper end of said sloping cradle and wherein said leg means further elevates said upper end of said sloping cradle;

a coin bander wherein said coin bander has a first rigid end and a second rigid end and wherein said coin bander has two flexible bands extending from said first rigid end to said second rigid end and wherein each flexible band is further fixed to said first rigid end and said second rigid end;

a sliding U latch fixed to said first rigid end;

a sliding T latch fixed to said second rigid end wherein said sliding T latch is inserted into said slot of said slotted end and wherein said adjusting bar is inserted into said sliding U and wherein said adjusting bar is inserted into said sliding U latch thus latching said coin bander to said adjustable support cradle wherein said coin bander is held in a fixed position while coins are inserted into said coin bander and further once coins are inserted into said coin bander said coin bander is easily removed from said adjustable support cradle.

* * * * *